United States Patent [19]

Fujimura

[11] 4,426,722

[45] Jan. 17, 1984

[54] X-RAY MICROBEAM GENERATOR

[75] Inventor: Osamu Fujimura, New Providence, N.J.

[73] Assignee: Bell Telephone Laboratories, Incorporated, Murray Hill, N.J.

[21] Appl. No.: 243,331

[22] Filed: Mar. 12, 1981

[51] Int. Cl.[3] ..... H01J 35/00

[52] U.S. Cl. ..... 378/137; 250/399; 378/138

[58] Field of Search ..... 250/493, 503, 399, 401, 250/416 TV, 396 R, 396 ML; 313/55, 59; 378/137, 138

[56] References Cited

U.S. PATENT DOCUMENTS

| | | | |
|---|---|---|---|
| 3,502,925 | 3/1970 | Herglotz | 378/138 |
| 3,852,605 | 12/1974 | Watanabe et al. . | |
| 3,867,637 | 2/1975 | Braun et al. | 250/503 |
| 3,949,227 | 4/1976 | Albert | 250/416 TV |
| 4,007,375 | 2/1977 | Albert | 378/137 |
| 4,057,745 | 11/1977 | Albert | 378/137 |
| 4,147,935 | 4/1979 | Warrikhoff . | |
| 4,158,138 | 6/1979 | Hellstram . | |
| 4,158,142 | 6/1979 | Haimson | 378/138 |
| 4,200,794 | 4/1980 | Newberry et al. | 250/396 ML |

OTHER PUBLICATIONS

"Computer Controlled Radiography for Observation of Movements of Articulatory and other Human Organs", Fujimura et al., *Comput Biol. Med.*, vol. 3, pp. 371-384, 1973.

"A new type of Cathode Ray Tube Suitable for Bubble Chamber Film Measurements", Shibata et al., *Nucl. Instr. and Methods*, vol. 123, 1975, pp. 431-438.

*Primary Examiner*—Bruce C. Anderson

*Attorney, Agent, or Firm*—Jack S. Cubert; Kurt C. Olsen

[57] ABSTRACT

An arrangement for generating x-ray microbeams includes an electron source for generating an electron beam. The electron beam is directed toward a target comprising discrete x-ray emissive spots. X-rays from the spots are formed into microbeams and directed through an examination field.

22 Claims, 9 Drawing Figures

X-RAY MICROBEAM GENERATOR

BACKGROUND OF THE INVENTION

My invention relates to radiology, and in particular, to arrangements for generating x-ray microbeams.

Most familiar radiology systems operate with "flood" x-rays, that is, x-rays which are diffuse. An x-ray microbeam by comparison, is narrow and sharply formed; the x-ray image is confined to a small area. The essential advantage of an x-ray microbeam system is that successive areas of exposure may be determined interactively, for example, by computer.

X-ray microbeam generators have been developed in which an x-ray emissive target is scanned with a computer controlled electron beam. X-rays from the target are formed into a microbeam. The microbeam, which scans in accordance with the electron beam, is directed through an irradiation field. For radiography, an array of detectors is used to intercept x-rays attenuated by an object in the examination field. Radiopacity signals from the detector array are processed to yield radiographic information.

Prior generators produce a continuous x-ray microbeam, however, which may degrade radiographic information due to scattering and boundary effects at the detector. Further, continuous microbeam systems may not satisfy positional accuracy and reproducibility requirements in certain applications, such as, speech research and integrated circuit mask fabrication. It is therefore an object of the invention to provide an improved arrangement for developing precisely directed x-ray microbeams.

SUMMARY OF THE INVENTION

The invention is directed to x-ray microbeam generating arrangements. A target has a plurality of discrete x-ray emissive spots. The spots are scanned by an electron beam. X-rays from the spots are formed into a plurality of discrete microbeams. The microbeams are directed through an examination field.

According to one aspect of the invention, the target is an x-ray transmission type target.

According to another aspect of the invention, the target is an x-ray reflection type target.

According to another aspect of the invention, microbeam forming means is movable between the target and the examination field in order to accomplish variable spatial resolution.

DETAILED DESCRIPTION

Figure 1:
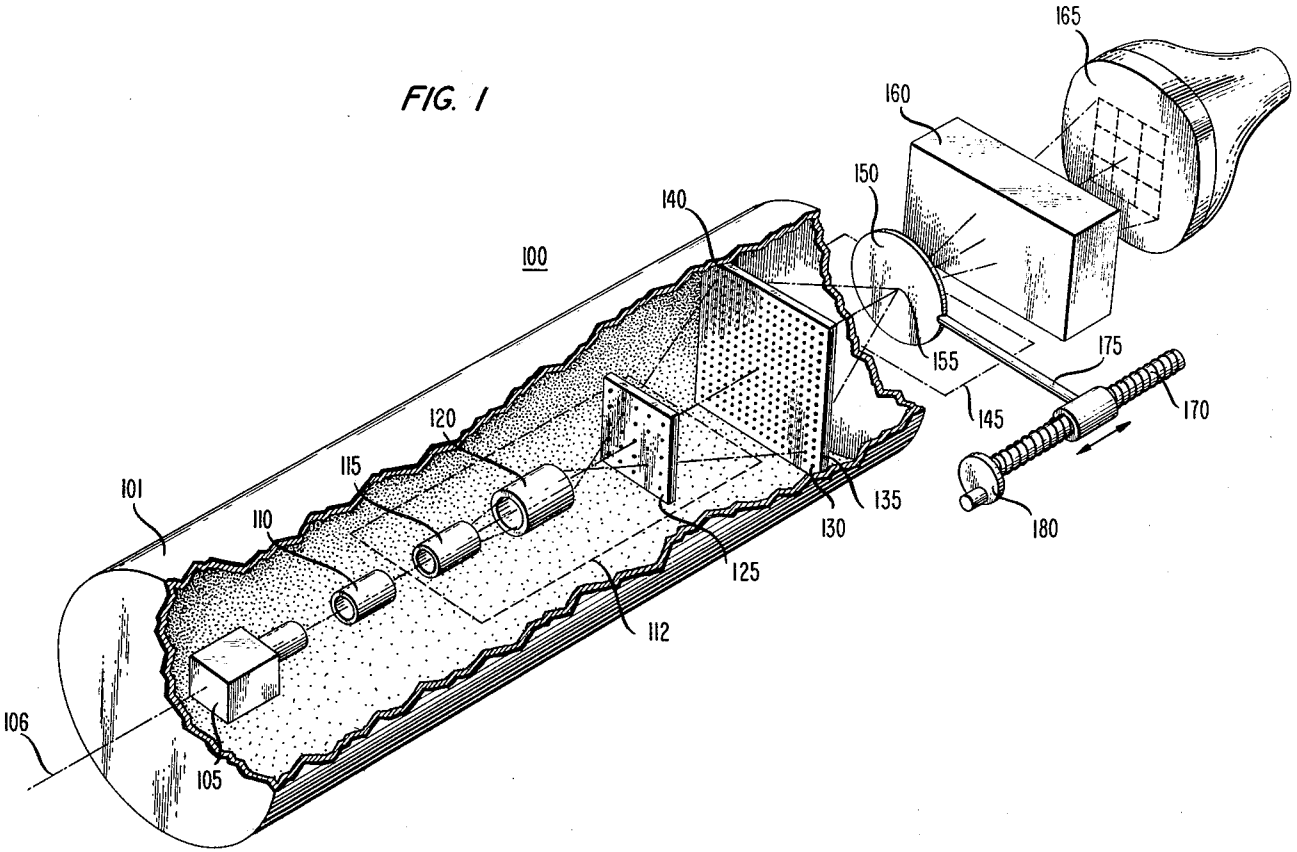
FIG. 1 is a perspective drawing of one embodiment illustrative of the invention.

FIG. 1 shows a perspective view of an x-ray microbeam generator 100 constructed according to the present invention. Vacuum chamber 101 encloses the x-ray generation system. An electron source 105 supplies an electron beam along the longitudinal axis 106 of the system. Electron source 105 may comprise any well known electron producing structure, for example, a hot filament electron emitter. The focus of the electron beam generated by electron source 105 is refined by focusing coil 110. The electron beam from focusing coil 110 is directed through the first stage of deflection means 112 consisting of means 115 and 120 for scanning the electron beam. Scanning means 115 and 120 may be electromagnetic deflection coils, as shown in FIG. 1. Alternatively, electrostatic deflectors may be substituted for electromagnetic deflection coils, as is well known in the art.

Scanning means 115 and 120 direct the electron beam through the second stage of deflection means 112 consisting of aperture lens matrix 125. Aperture lens matrix 125 is a perforated metallic plate similar to the shadow mask in color television tubes. An aperture lens matrix for two stage deflection is further described in an article by S. Shibata et al, entitled "A New Type of Cathode Ray Tube Suitable for Bubble Chamber Film Measurements," Nuclear Instruments and Methods, Vol. 123 (1975) pages 431–438.

Aperture lens matrix 125 is a simple structure for obtaining precise positional control of the electron beam. It is possible, however, to omit aperture lens matrix 125. Positional accuracy of the electron beam can be achieved by increasing the complexity (and cost) of the focusing and scanning control circuitry.

The electron beam from aperture lens matrix 125 is directed to target 135. Target 135 may be, for example, perpendicular to longitudinal axis 106 of the system. Target 135 comprises a metallic anode 140 having a plurality of discrete x-ray emissive spots 130. The spots consist of an x-ray emissive material, such as, tungsten or gold. The spots may be arranged in a matrix or other patterns designed, for example, to minimize distortions caused by the geometry of the system.

Precise positional control of the electron beam, as accomplished, for example, with the aforementioned two stage deflection system, is necessary in order to accurately select particular x-ray emissive spots 130 for irradiation. A sequence of spots is scanned with the electron beam to produce a corresponding sequence of discrete x-rays. If, for example, the electron beam were scanned across five horizontally adjacent spots on target 135, a sequence of five separate x-ray beams would result.

In contrast, x-ray emissive material covers the entire target surface in prior generators. A horizontal scan, for example, would result in a single moving x-ray beam instead of the discrete beams of the present invention.

Figure 3:
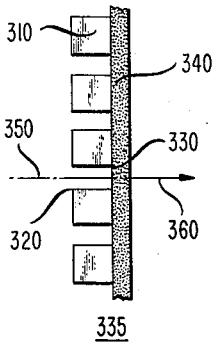
FIG. 3 is a side view of a target useful in the embodiment of FIG. 1.
Figure 4:
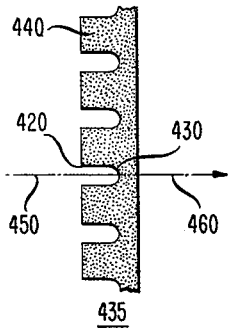
FIG. 4 is a side view of another target useful in the embodiment of FIG. 1.
Figure 5:
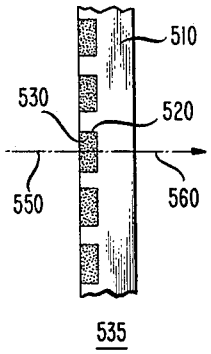
FIG. 5 is a side view of a further target useful in the embodiment of FIG. 1.

Target 135 may be constructed as shown, for example, in FIGS. 3, 4 and 5. In FIG. 3, plate 340 comprises a sheet of x-ray emissive material, such as, tungsten or gold. Plate 340 is flush with base 310. Base 310 has a plurality of holes. Each surface of plate 340 which forms the bottom of each hole in base 310 defines an x-ray emissive spot. The area of plate 340 at the bottom of hole 320, for example, defines x-ray emissive spot 330. Incidence of electron beam 350 upon spot 330 stimulates the emission of x-ray 360. Since x-ray 360 is emitted on the opposite side of plate 340 from incident electron beam 350, target 335 is an x-ray transmission type target.

FIG. 4 shows another transmission type target 435. Plate 440 comprises a sheet of x-ray emissive material, such as, tungsten or gold. Plate 440 has a plurality of cavities. Each surface of plate 440 which forms the bottom of each cavity defines an x-ray emissive spot. The area at the bottom of cavity 420, for example, defines x-ray emissive spot 430. Incidence of electron beam 450 on spot 430 stimulates the emission of x-ray 460.

Alternatively, the orientation of the targets may be reversed from that shown in FIGS. 3 and 4. Hole 320 and cavity 420, for example, may face in the direction of x-ray emission instead of toward the incident electron beam. The resultant x-rays are thereby collimated to avoid undesirable scattering.

FIG. 5 shows yet another transmission type target 535. Base 510 comprises a metallic sheet, such as, copper. A plurality of pellets, comprising an x-ray emissive material, such as, tungsten or gold, are embedded on base 510. The surface of each pellet which faces electron beam 550 defines an x-ray emissive spot. Pellet 520, for example, defines x-ray emissive spot 530. Incidence of electron beam 550 on spot 530 stimulates the emission of x-ray 560.

In FIG. 1, x-rays from target 135 are directed through microbeam forming means 145. Microbeam forming means 145 may comprise a shield 150 of x-ray absorptive material, such as, lead, having pinhole lens 155. Pinhole lens 155 forms the x-rays from target 135 into pencil-shaped microbeams. Since each microbeam originates from a particular spot on target 135, each microbeam is directed through a single corresponding location of an object 160 in the examination field.

Figure 6:
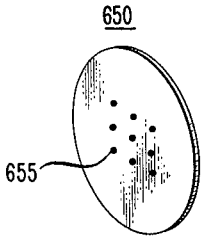
FIG. 6 is a perspective drawing of microbeam forming means useful in the embodiments of FIGS. 1 and 2.

In accordance with the invention, a plurality of pinhole lenses may be substituted for the single pinhole lens 155 of microbeam forming means 145. Referring to FIG. 6, shield 650 has, for example, nine pinhole lenses 655. X-rays from a particular spot on target 135 would therefore be simultaneously formed into nine microbeams directed simultaneously through nine spaced locations of object 160. As compared with a single pinhole lens, a multiple pinhole lens decreases the time required to irradiate a given area. A single pinhole lens, on the other hand, provides greater selectivity of object areas for exposure.

Figure 7:
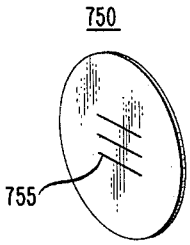
FIG. 7 is a perspective drawing of another microbeam forming means useful in the embodiments of FIGS. 1 and 2.

Another alternative arrangement for microbeam forming means 145 is shown in FIG. 7. Shield 750 has at least one slit lens 755. Slit lens 755 forms x-rays from target 135 into a fan-shaped microbeam. In operation, the electron beam is controlled to scan one column of spots on target 135, thereby producing a vertical series of fan-shaped microbeams. Additional slit lenses may be provided to generate a corresponding number of fan-shaped microbeams simultaneously from each spot on target 135.

Microbeam forming means 145 in FIG. 1 can be moved along the longitudinal axis 106 of the system for changing the spatial resolution of the microbeams incident on object 160 (zooming). For illustration, the means for moving microbeam forming means 145 comprises worm gear 170 and follower 175. Worm gear 170 may be turned with hand wheel 180 for moving follower 175 and attached microbeam forming means 145 longitudinally.

The microbeams from microbeam forming means 145 are directed through object 160. For radiography, detector array 165 intercepts microbeams attenuated by object 160. (For radiotherapy, the detector array may be omitted.) Since the position of each discrete x-ray microbeam is fixed accurately in advance, the incident area of each attenuated microbeam on detector array 165 is known with precision. Thus, only those radiopacity signals from specified incident areas on detector array 165 are significant. Signals from other areas, caused by x-ray scattering and boundary effects, may be ignored. The significant radiopacity signals from detector array 165 are processed by a computer to reconstruct an image of object 160 in a conventional way. The reconstructed image has improved clarity since spurious signals from detector array 165 are not processed. Radiodose to object 160 may therefore be lowered.

Figure 2:
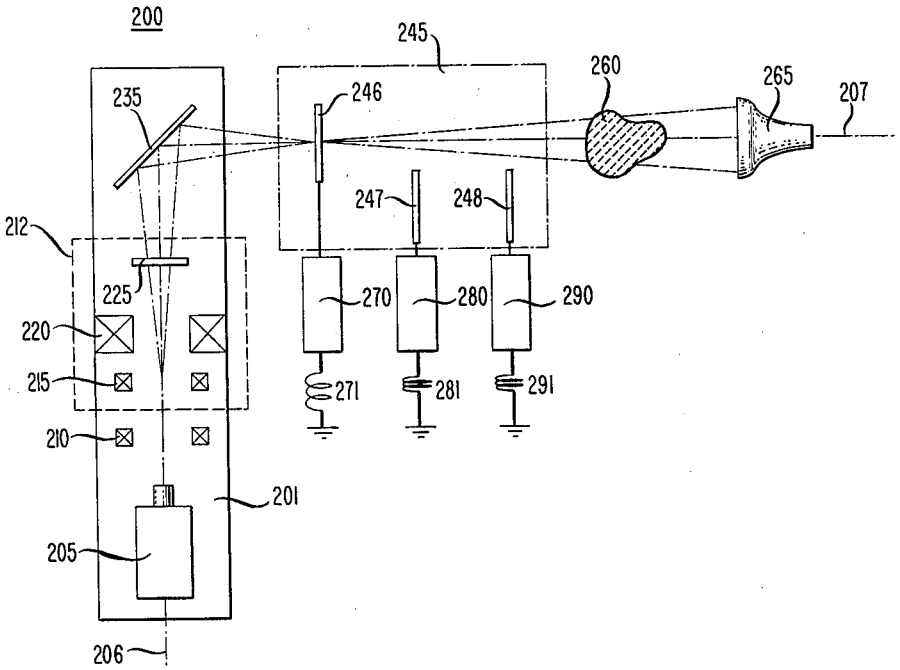
FIG. 2 is a plan view of another embodiment illustrative of the invention.

Referring to FIG. 2, a reflection type x-ray microbeam generator 200 is shown. Vacuum chamber 201 encloses the x-ray generation system. Electron source 205 produces an electron beam. The electron beam is focused by focusing coil 210. In deflection means 212, the focused electron beam is caused to scan by scanning means 215 and 220. The scanning electron beam is directed through aperture lens matrix 225 to more accurately control the position of the electron beam.

The electron beam is directed from aperture lens 225 to target 235. Target 235 has a plurality of discrete x-ray generating spots which emit x-rays responsive to the incidence of the electron beam. Since x-rays are emitted on the same side of the target that the electron beam strikes, target 235 is a reflection type target. Target 235 may be perpendicular to the angle between longitudinal axis 206 and lateral axis 207 of the system. If longitudinal axis 206 and lateral axis 207 form a 90° angle, for example, target 235 forms a 45° angle with each axis.

Figure 8:
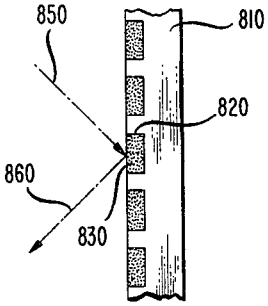
FIG. 8 is a side view of another target useful in the embodiment of FIG. 2.

Target 235 may be constructed as shown, for example, in FIG. 8. Base 810 comprises a metallic sheet, such as, copper. A plurality of pellets, comprising an x-ray emissive material, such as, tungsten or gold, are embedded on base 810. The surface of each pellet which faces electron beam 850 defines an x-ray emissive spot. Pellet 820, for example, defines x-ray emissive spot 830. The incidence of electron beam 850 on spot 830 causes the emission of x-ray 860.

X-rays from target 235 in FIG. 2 are directed through microbeam forming means 245. For illustration, x-ray forming means 245 comprises three x-ray absorptive shields 246, 247 and 248. Each shield may have, for example, a single or multiple pinhole lens arrangement, as previously described and shown with reference to FIGS. 1 and 6. Alternatively, a single or multiple slit lens arrangement may be used, as previously described and shown with reference to FIG. 7.

Shields 246, 247 and 248 are arranged at different distances between target 235 and object 260. Selectable stages of spatial resolution are thereby provided.

In the first stage, a gross examination mode, solenoid 270 is energized to extend shield 246 into the operative position. For the second stage, an intermediate mode, solenoid 280 is energized to extend shield 247 into the operative position. Simultaneously, solenoid 270 is de-energized and shield 246 is restored to the nonoperative position by a suitable restoring element such as tension spring 271. For a close-up examination, solenoid 290 is energized to extend shield 248 into the operative position. Solenoid 280 is de-energized and tension spring 281 retracts shield 247. Shield 248 may be restored to the inoperative position by tension spring 291 when solenoid 290 is de-energized.

Figure 9:
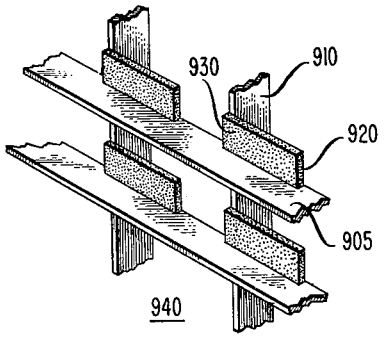
FIG. 9 is a perspective drawing of yet another target useful in the embodiments of FIGS. 1 and 2.

An alternative target, suitable for both the transmission type x-ray generator of FIG. 1 and the reflection type x-ray generator of FIG. 2, is shown in FIG. 9. Anode 940 is comprised of a mesh of horizontal and vertical bars. Plates, formed from an x-ray emissive material, such as, tungsten or gold, are attached at intersections of the bars. At the intersection of bars 905 and 910, for example, plate 920 is attached. The surface of plate 920 defines an x-ray emissive spot 930.

While particular embodiments of the invention have been shown and described, it is to be understood that numerous changes may be made in form and details without departing from the scope and spirit of the invention. For example, the movable microbeam forming means for zooming, shown with the transmission type x-ray generator in FIG. 1, may also be used with the reflection type microbeam generator in FIG. 2. Similarly, the selectable x-ray forming means for multiple stage examination, shown with the reflection type x-ray generator in FIG. 2, is also applicable to the transmission type x-ray generator of FIG. 1. Further, the object itself may be moved to achieve zooming and to select different areas of the object for exposure.

What is claimed is:

1. An x-ray microbeam generator comprising
an electron source for producing an electron beam,
means for focusing said electron beam,
means for deflecting said focused electron beam,
a target responsive to the incidence of said deflected electron beam for producing x-rays,
means for forming said x-rays into a microbeam directed through an examination field,
characterized in that
said target (135 or 235) comprises
an anode (140 or 240) having a plurality of spaced spots (130), said spots including material for producing x-rays responsive to the incidence of said electron beam;
said electron beam deflection means (112 or 212) comprises
means for controlling said electron beam to impinge sequentially upon a plurality of said spots in a predetermined pattern to emit a corresponding sequence of x-rays; and
said microbeam forming means (145 or 245) comprises
means for selectively blocking said sequence of emitted x-rays so that at least one x-ray from each spot irradiates a different portion of the examination field, the location of said portions being correlated to said predetermined pattern of spots.

2. Apparatus as in claim 1 further characterized in that
said electron beam deflection means (112 or 212) comprises
a matrix of aperture lenses (125 or 225) positioned between said means (115, 120 or 215, 220) for controlling said electron beam and said target (135 or 235).

3. Apparatus as in claim 1 characterized in that
said target (135) is perpendicular to the longitudinal axis (106) of said generator (100),
whereby x-rays produced responsive to the incidence of said deflected electron beam are transmitted through said target.

4. Apparatus as in claim 3 further characterized in that
said anode (140) comprises
a base (310) having a plurality of holes (320),
an x-ray emissive plate (340) attached flat against said base (310); and
said spots (130) comprise the surfaces of said x-ray emissive plate (340) which define the bottoms of said holes (320).

5. Apparatus as in claim 3 further characterized in that
said anode (140) comprises
an x-ray emissive plate (440) having a plurality of cavities (420); and
said spots (130) comprise the surfaces of said x-ray emissive plate (440) which define the bottoms of said cavities (420).

6. Apparatus as in claims 4 or 5 further characterized in that
said x-ray emissive plate (340 or 440) comprises tungsten.

7. Apparatus as in claims 4 or 5 further characterized in that
said x-ray emissive plate (340 or 440) comprises gold.

8. Apparatus as in claim 3 further characterized in that
said anode (140) comprises
a base (510) having a plurality of x-ray emissive pellets (520) embedded on said base (510); and
said spots (130) comprise the surfaces of said x-ray emissive pellets (520) which face said electron beam (550).

9. Apparatus as in claim 1 further characterized in that
said target (235) is perpendicular to the angle between the longitudinal axis (206) and the lateral axis (207) of said generator (200),
whereby x-rays produced responsive to the incidence of said deflected electron beam are reflected from said target.

10. Apparatus as in claim 9 further characterized in that
said anode (240) comprises
a base (810) having a plurality of x-ray emissive pellets (820) embedded on said base (810); and
said spots comprise the surfaces of said x-ray emissive pellets (820) which face said electron beam (850).

11. Apparatus as in claims 8 or 10 further characterized in that
said x-ray emissive pellets (520 or 820) comprise tungsten.

12. Apparatus as in claims 8 or 10 further characterized in that
said x-ray emissive pellets (520 or 820) comprise gold.

13. Apparatus as in claims 3 or 9 further characterized in that
said anode (140 or 240) comprises
a plurality of horizontal and vertical bars (905, 910) forming a mesh,
a plurality of x-ray emissive plates (920) attached at the intersections of said bars; and
said spots (130) comprise the surfaces of said x-ray emissive plates (920) which face said electron source (105 or 205).

14. Apparatus as in claim 13 further characterized in that said x-ray emissive plates (920) comprise tungsten.

15. Apparatus as in claim 13 further characterized in that said x-ray emissive plates (920) comprise gold.

16. Apparatus as in claim 1 further characterized in that said microbeam forming means (145) comprises an x-ray absorptive shield (150) having at least one pinhole lens (155).

17. Apparatus as in claim 1 further characterized in that said microbeam forming means (145) comprises an x-ray absorptive shield (750) having at least one slit lens (755).

18. Apparatus as in claims 16 or 17 further characterized in that said generator (100) comprises means (170, 175, 180) for moving said x-ray forming means (145) longitudinally between said target and said examination field, whereby the spatial resolution of microbeams directed through said examination field is alterable.

19. Apparatus as in claim 1 further characterized in that said x-ray forming means (245) comprises a plurality of x-ray absorptive shields (246, 247, 248), said shields being spaced at different distances between said target (235) and said examination field, and said generator (200) comprises means (270, 280, 290) for selectively positioning any one of said shields in order to intercept x-rays from said target, whereby the spatial resolution of microbeams directed through said examination field is alterable.

20. Apparatus as in claim 19 further characterized in that said x-ray absorptive shields (246, 247, 248) each have at least one pinhole lens.

21. Apparatus as in claim 19 further characterized in that said x-ray absorptive shields (246, 247, 248) each have at least one slit lens.

22. Apparatus as in claim 1 further characterized in that said generator (100 or 200) comprises a detector (165 or 265) responsive to the attenuation of said microbeam within said irradiation field for generating radiopacity signals.

* * * * *